US011332943B2

(12) United States Patent
Starkweather et al.

(10) Patent No.: US 11,332,943 B2
(45) Date of Patent: May 17, 2022

(54) WALL COVERING WITH ADJUSTABLE SPACING

(71) Applicant: D.A. Distribution Inc., Spring Lake Park, MN (US)

(72) Inventors: Scott G. Starkweather, Minneapolis, MN (US); Antoniy R. Petkov, New Brighton, MN (US)

(73) Assignee: D.A. Distribution Inc., Spring Lake Park, MN (US)

( * ) Notice: Subject to any disclaimer, the term of this patent is extended or adjusted under 35 U.S.C. 154(b) by 0 days.

(21) Appl. No.: 17/066,355

(22) Filed: Oct. 8, 2020

(65) Prior Publication Data

US 2021/0102380 A1 Apr. 8, 2021

Related U.S. Application Data

(60) Provisional application No. 63/050,675, filed on Jul. 10, 2020, provisional application No. 62/978,203, (Continued)

(51) Int. Cl.
*E04F 13/08* (2006.01)
*E04F 13/14* (2006.01)

(52) U.S. Cl.
CPC ..... *E04F 13/0835* (2013.01); *E04F 13/0853* (2013.01); *E04F 13/147* (2013.01)

(58) Field of Classification Search
CPC .. E04F 13/0853; E04F 13/147; E04F 13/0835
See application file for complete search history.

(56) References Cited

U.S. PATENT DOCUMENTS 448,733 A 3/1891 Sagendorph
897,353 A 9/1908 Culley
(Continued)

FOREIGN PATENT DOCUMENTS

AU 2004242129 A1 12/2004
AU 2006315114 A1 5/2007
(Continued)

OTHER PUBLICATIONS

"Complaint for Patent Infringement", *Boral Stone Products LLC*, v. *D.A. Distribution, Inc. d/b/a Waypost Stone Siding, Boulder Creek Stone and Brick Co., and Condor Fireplace and Stone Co.* , United States District Court for the District of Minnesota (Case 0:19-cv-02464), 60 pgs.

(Continued)

*Primary Examiner* — Babajide A Demuren
(74) *Attorney, Agent, or Firm* — Schwegman Lundberg & Woessner, P.A.

(57) ABSTRACT

Disclosed herein, among other things, are system, methods and apparatuses for wall coverings with adjustable spacing. One aspect of the present subject matter relates to a concrete wall panel including a mounting system that includes a decorative panel with a flange embedded within the panel, the flange having mounting features providing for a number of ways to mount a plurality of such panels to a wall or other planar surface. The mounting system allows for fasteners to be used to connect the wall panel to a wall and provides a mount that has an air gap to allow for air to flow and for any moisture to pass between the wall inner surface and behind the wall panels.

20 Claims, 16 Drawing Sheets

Related U.S. Application Data filed on Feb. 18, 2020, provisional application No. 62/912,635, filed on Oct. 8, 2019.

(56) References Cited

U.S. PATENT DOCUMENTS 1,276,894 A 8/1918 Flanders
1,592,591 A 7/1926 James et al.
1,688,405 A 10/1928 Stoehr et al.
1,853,822 A 4/1932 Joseph et al.
1,853,824 A 4/1932 Joseph et al.
1,859,539 A 5/1932 Kemper et al.
1,872,522 A 8/1932 Stuckey et al.
1,976,947 A 10/1934 Krauss
2,006,635 A 7/1935 Farr et al.
2,018,805 A 10/1935 Antoinette
2,031,680 A 2/1936 Lloyd et al.
2,039,556 A 2/1936 Ernest et al.
2,182,523 A 12/1939 Markowski et al.
2,198,466 A 4/1940 Stolze et al.
2,205,700 A 6/1940 Smith
2,209,283 A 7/1940 Ronzone et al.
2,214,387 A 9/1940 Snyder et al.
2,300,258 A 10/1942 Joseph et al.
2,305,280 A 12/1942 Strunk et al.
D135,476 S 4/1943 Wright
2,317,428 A 4/1943 Anderson et al.
D135,475 S 8/1943 Wright
2,329,610 A 9/1943 Harman et al.
2,592,244 A 4/1952 Chamberlain et al.
2,884,780 A 5/1959 Chavez et al.
2,991,592 A 7/1961 Rauen et al.
3,004,369 A 10/1961 Kendrick et al.
3,131,514 A 5/1964 Metta et al.
3,142,938 A 8/1964 Eberhardt et al.
3,177,279 A 4/1965 Bilodeau et al.
3,192,556 A 7/1965 Himelreich et al.
3,217,453 A 11/1965 Medow et al.
3,232,017 A 2/1966 Prusinski et al.
3,248,834 A 5/1966 Charles et al.
3,303,620 A 2/1967 William et al.
3,310,921 A 3/1967 Perez et al.
3,332,187 A 7/1967 Arcari et al.
3,335,048 A 8/1967 Leon et al.
3,344,011 A 9/1967 Murray et al.
3,350,827 A 11/1967 Sugar et al.
3,388,518 A 6/1968 Scott et al.
3,478,479 A 11/1969 Papalia et al.
3,496,694 A 2/1970 Hicks et al.
3,521,418 A 7/1970 Bartoloni et al.
3,524,790 A 8/1970 Mason et al.
3,533,206 A 10/1970 Passeno et al.
3,613,326 A 10/1971 Mollman et al.
3,618,888 A 11/1971 Wise et al.
3,621,625 A 11/1971 Medow et al.
3,646,715 A 3/1972 Pope et al.
3,683,579 A 8/1972 Beardsley et al.
3,701,228 A 10/1972 Taylor et al.
3,740,910 A 6/1973 Taylor et al.
3,740,911 A 6/1973 O
3,750,998 A 8/1973 Shoe et al.
3,754,365 A 8/1973 Carrick et al.
3,837,133 A 9/1974 Mollman
3,867,503 A 2/1975 Shoe et al.
3,868,801 A 3/1975 Weiner et al.
3,885,008 A 5/1975 Martin et al.
3,899,344 A 8/1975 Jakel
3,905,170 A 9/1975 Huettemann et al.
3,908,326 A 9/1975 Francis et al.
3,968,610 A 7/1976 Medow et al.
4,001,361 A 1/1977 Unruh
4,011,702 A 3/1977 Matyas et al.
4,026,083 A 5/1977 Hoyt et al.
4,034,528 A 7/1977 Sanders et al.
4,037,377 A 7/1977 Howell et al.
4,065,902 A 1/1978 Lindal et al.
4,102,106 A 7/1978 Golder et al.
4,191,521 A 3/1980 Muldery et al.
4,219,984 A 9/1980 De et al.
4,223,490 A * 9/1980 Medow ..... E04F 13/08 52/314
4,241,554 A 12/1980 Infantino
4,266,382 A 5/1981 Tellman et al.
4,267,221 A 5/1981 Ishikawa
4,271,111 A 6/1981 Sheber et al.
4,299,069 A 11/1981 Neumann et al.
4,306,395 A 12/1981 Carpenter et al.
4,349,588 A 9/1982 Schiffer et al.
4,404,158 A 9/1983 Robinson
4,407,104 A 10/1983 Francis
4,453,359 A 6/1984 Robinson
4,468,903 A 9/1984 Eaton et al.
4,495,738 A 1/1985 Sheber
4,522,002 A 6/1985 Davis et al.
4,531,338 A 7/1985 Donatt
4,553,366 A 11/1985 Guerin
4,589,241 A 5/1986 Volpenhein
4,638,617 A 1/1987 James
4,644,719 A 2/1987 Salazar
4,655,719 A 4/1987 Sunray
4,656,722 A 4/1987 Armstrong
4,665,673 A 5/1987 Diana
4,669,238 A 6/1987 Kellis et al.
4,680,911 A 7/1987 Davis et al.
4,689,931 A 9/1987 Hodges
4,773,201 A 9/1988 Trezza
4,858,410 A 8/1989 Goldman
4,920,716 A 5/1990 Coffey
4,932,182 A 6/1990 Thomasson
4,944,124 A 7/1990 Armstrong
4,946,632 A 8/1990 Pollina
5,029,425 A 7/1991 Bogataj
5,042,215 A 8/1991 Cremer et al.
5,052,161 A 10/1991 Whitacre
5,072,562 A 12/1991 Crick et al.
5,076,037 A 12/1991 Crick et al.
5,172,532 A 12/1992 Gibbar, Jr.
5,228,249 A 7/1993 Campbell
5,228,937 A 7/1993 Passeno
5,232,646 A 8/1993 Nasvik et al.
5,249,402 A 10/1993 Crick et al.
5,271,878 A 12/1993 Mizia et al.
5,311,714 A 5/1994 Passeno
5,347,784 A 9/1994 Crick et al.
5,373,676 A 12/1994 Francis et al.
5,379,561 A 1/1995 Saito
5,398,473 A 3/1995 Chan
5,515,659 A 5/1996 MacDonald et al.
5,537,792 A 7/1996 Moliere
5,540,023 A 7/1996 Jaenson
5,557,897 A 9/1996 Kranz et al.
5,634,305 A 6/1997 Erlanger
5,637,236 A 6/1997 Lowe
5,673,529 A 10/1997 Treister et al.
5,715,305 A 2/1998 Penzias et al.
5,715,637 A 2/1998 Hesterman et al.
5,785,904 A 7/1998 Abou-Rached
5,787,666 A 8/1998 Sherry
5,819,486 A 10/1998 Goodings
5,833,895 A 11/1998 Di
5,836,123 A 11/1998 Gulino
5,836,572 A 11/1998 Sugiyama
5,857,303 A 1/1999 Beck et al.
5,878,543 A 3/1999 Mowery
5,890,340 A 4/1999 Kafarowskl
5,916,103 A 6/1999 Roberts
5,956,914 A 9/1999 Williamson
5,966,886 A 10/1999 Di
6,029,418 A 2/2000 Wright
6,050,037 A 4/2000 Gifford
6,129,329 A 10/2000 Nasvik et al.
6,134,855 A 10/2000 Beck
6,151,854 A 11/2000 Gutjahr
6,164,029 A 12/2000 Lee
6,237,288 B1 5/2001 Jenkins et al.

(56) References Cited

U.S. PATENT DOCUMENTS 6,237,294 B1 5/2001 Rygiel
6,240,691 B1 6/2001 Holzkaemper et al.
6,244,009 B1 6/2001 Cerrato
6,253,511 B1 7/2001 Boyer
6,253,515 B1 7/2001 Kuelker
6,295,777 B1 10/2001 Hunter et al.
6,315,489 B1 11/2001 Watanabe
6,324,807 B1 12/2001 Ishiko
6,336,303 B1 1/2002 Vandeman et al.
6,355,193 B1 3/2002 Stott
6,408,585 B1 6/2002 Tajima
6,460,301 B1 10/2002 Mckee
6,467,229 B2 10/2002 Azar
6,516,578 B1 2/2003 Hunsaker
6,523,309 B1 2/2003 Finlay et al.
6,599,452 B1 7/2003 Ferguson
6,609,342 B2 8/2003 Hikai
6,615,560 B2 9/2003 Ito
6,634,617 B2 10/2003 Potvin
6,701,683 B2 3/2004 Messenger et al.
6,729,090 B2 5/2004 Messenger et al.
6,792,727 B2 9/2004 Krieger
D497,013 S 10/2004 Hughes
6,802,165 B1 10/2004 Passeno
6,808,667 B2 10/2004 Nasvik et al.
6,820,383 B2 11/2004 Vos
6,830,405 B2 12/2004 Watanabe
6,857,248 B2 2/2005 Ouellet et al.
6,898,908 B2 5/2005 Messenger et al.
6,904,780 B2 6/2005 Bullinger
D510,146 S 9/2005 Attebery, II et al.
6,939,599 B2 9/2005 Clark
6,951,086 B2 10/2005 Passeno
6,955,019 B2 10/2005 Donlin et al.
6,968,659 B2 11/2005 Boyer
6,973,756 B2 12/2005 Hatzinikolas
6,990,778 B2 1/2006 Passeno et al.
6,991,205 B2 1/2006 Myers et al.
7,028,436 B2 4/2006 Bezubic, Jr.
RE39,091 E 5/2006 Kuelker
7,096,629 B1 8/2006 Cox
7,240,461 B1 7/2007 Vandeman et al.
7,587,871 B2 9/2009 Perry
7,617,647 B2 11/2009 Turner et al.
7,647,738 B2 1/2010 Nasvik
7,735,287 B2 6/2010 Gaudreau
7,790,784 B2 9/2010 Nasr et al.
7,980,037 B2 7/2011 Trabue et al.
7,997,039 B2 8/2011 Wolf et al.
8,042,309 B2 * 10/2011 Wolf ..... E04F 13/185 52/314
8,151,530 B2 4/2012 Schwarz et al.
8,201,372 B2 6/2012 Holt et al.
8,256,179 B2 9/2012 Nasvik
8,387,323 B2 3/2013 Mickelson
8,601,764 B2 12/2013 Cahill et al.
8,707,649 B2 * 4/2014 Wilkie ..... E04F 13/0892 52/533
8,782,988 B2 7/2014 Wolf et al.
9,249,579 B2 2/2016 Dickey et al.
9,428,921 B2 8/2016 Hawk
9,903,124 B2 * 2/2018 Wolf ..... E04F 15/02038
9,957,723 B1 5/2018 Collison
10,329,775 B2 * 6/2019 Wolf ..... E04F 13/147
RE47,694 E 11/2019 Buoni et al.
10,557,273 B2 2/2020 Wolf et al.
10,927,552 B2 * 2/2021 Crosier ..... E04F 13/0733
11,035,128 B2 * 6/2021 Steffes ..... E04F 13/0894
11,047,134 B2 * 6/2021 Steffes ..... E04F 13/0801
2003/0066259 A1 4/2003 Sudweeks
2003/0154676 A1 8/2003 Schwartz
2004/0006943 A1 1/2004 Weick
2004/0107663 A1 6/2004 Waggoner
2005/0005556 A1 1/2005 Collier et al.
2005/0102946 A1 5/2005 Stucky et al.
2005/0188642 A1 9/2005 Correia
2005/0204466 A1 9/2005 Luong
2005/0204666 A1 9/2005 Passeno
2005/0210811 A1 9/2005 Nasvik
2005/0229500 A1 10/2005 Howard
2005/0252144 A1 11/2005 MacDonald et al.
2005/0257475 A1 11/2005 Gong et al.
2006/0053743 A1 3/2006 Hatzinikolas
2006/0075712 A1 4/2006 Gilbert et al.
2006/0010761 A1 5/2006 Boserio
2006/0191232 A1 8/2006 Salazar et al.
2006/0204466 A1 9/2006 Littau et al.
2006/0260223 A1 11/2006 Wang
2006/0265988 A1 11/2006 Fujito et al.
2007/0022687 A1 2/2007 Correia
2007/0044402 A1 3/2007 Hess
2007/0119109 A1 5/2007 Kuelker
2007/0137128 A1 6/2007 Viau et al.
2007/0144087 A1 6/2007 Heath et al.
2007/0151190 A1 7/2007 Huff et al.
2007/0175159 A1 8/2007 Miniter
2007/0209308 A1 9/2007 Barrett
2007/0227087 A1 10/2007 Nasr et al.
2007/0261353 A1 11/2007 Cullen
2008/0005994 A1 1/2008 Harney
2008/0028711 A1 2/2008 Logan et al.
2008/0110116 A1 5/2008 Brown et al.
2008/0115435 A1 5/2008 Riviere
2008/0302050 A1 12/2008 Kalkanoglu
2008/0313988 A1 12/2008 Macdonald
2009/0049765 A1 2/2009 Grant
2009/0056257 A1 3/2009 Mollinger et al.
2009/0062413 A1 3/2009 Adur et al.
2009/0094914 A1 4/2009 Jambois et al.
2009/0113837 A1 5/2009 Mickelson
2009/0193742 A1 8/2009 Wolf et al.
2009/0235600 A1 9/2009 Logan et al.
2009/0249719 A1 10/2009 Broehl et al.
2009/0304459 A1 12/2009 MacDonald et al.
2011/0078972 A1 4/2011 Schwarz et al.
2011/0173922 A1 7/2011 Buoni
2011/0175255 A1 7/2011 Wemette et al.
2011/0239578 A1 10/2011 Wolf et al.
2012/0272598 A1 * 11/2012 Wilkie ..... E04F 13/0869 52/302.3
2013/0305646 A1 11/2013 Mann
2014/0041331 A1 2/2014 Buoni et al.

FOREIGN PATENT DOCUMENTS

CA 2152738 C 1/2001
CA 2529704 A1 * 6/2007 ..... E04F 13/0862
CA 2719709 A1 * 11/2009 ..... E04F 13/0835
CN 108277942 A 7/2018
DE 2044961 A1 3/1972
DE 102006008147 A1 8/2007
DE 202018103531 U1 10/2019
EP 0024359 A1 3/1981
EP 0088658 A1 9/1983
EP 0182567 A2 5/1986
EP 0088658 B1 6/1986
EP 0271400 B1 5/1991
EP 0285509 B1 6/1991
EP 0892125 A2 1/1999
FR 2461073 A1 1/1981
FR 2519675 A1 7/1983
FR 2561289 A1 9/1985
FR 2652371 A1 3/1991
FR 2768452 A1 3/1999
GB 444503 A 3/1936
GB 2371314 A 7/2002
JP H08326263 A 12/1996
JP H09111992 A 4/1997
JP 2000226926 A 8/2000
JP 2000297518 A 10/2000
JP 2001303751 A 10/2001
WO WO-2006042883 A2 4/2006
WO WO-2007065251 A1 * 6/2007 ..... B28B 23/005

(56) References Cited

FOREIGN PATENT DOCUMENTS

| | | | |
|---|---|---|---|
| WO | WO-2007142632 | A1 | 12/2007 |
| WO | WO-2015131283 | A1 | 9/2015 |
| WO | WO-2017074425 | A1 | 5/2017 |

OTHER PUBLICATIONS

"International Application Serial No. PCT/US2007/025532, International Search Report and Written Opinion dated Apr. 21, 2008", 9 pgs.
"International Application Serial No. PCT/US2009/033405, International Search Report and Written Opinion dated May 18, 2009", 10 pgs.
"Split Stem Bumper—Volt Industrial Plastics", Archive.org, [Online], Retrieved from the Internet: <URL: https://web.archive.org/web/20200811065807/https://voltplastics.com/products/details/350/split-stem-bumpers-2>, (Aug. 11, 2020), 2 pgs.
Buoni, Wayne Joseph, et al., "Wall Panel", U.S. Appl. No. 15/423,504, filed Feb. 2, 2017, 23 pgs.
Salonvarra, Mikael, et al., "Air Cavities Behind Claddings—What Have We Learned?", ASHRAE, (2007), 10 pgs.
Wolf, David, et al., "Method of Forming a Wall Panel", U.S. Appl. No. 14/299,250, filed Jun. 9, 2014, 26 pgs.

* cited by examiner

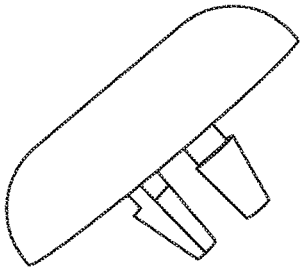
FIG. 3A
Split
Stem Bumper
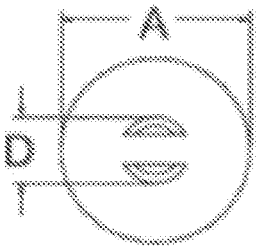
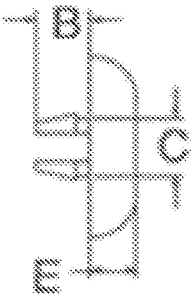
FIG. 3B FIG. 3C
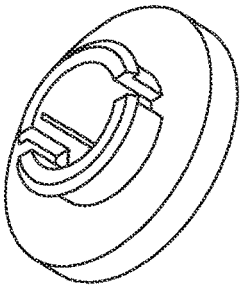
FIG. 4A
Bushing
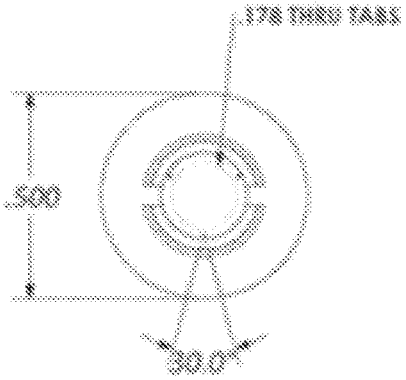
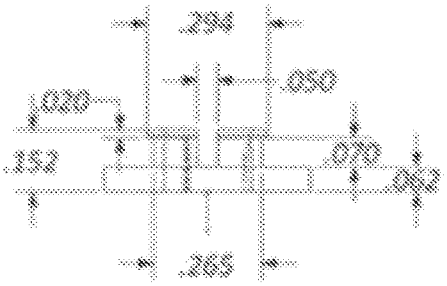
THIS BUSHING IS DESIGNED WITH AN OUTER DIAMETER OF .500 AND AN INNER DIAMETER OF .175.
FIG. 4B FIG. 4C Bottom of Panel Side View

WALL COVERING WITH ADJUSTABLE SPACING

CLAIM OF PRIORITY

This application claims the benefit under 35 U.S.C. § 119(e) of U.S. Provisional Patent Application Ser. No. 62/912,635, filed Oct. 8, 2019, and claims the benefit under 35 U.S.C. § 119(e) of U.S. Provisional Patent Application Ser. No. 62/978,203, filed Feb. 18, 2020, and claims the benefit under 35 U.S.C. § 119(e) of U.S. Provisional Patent Application Ser. No. 63/050,675, filed Jul. 10, 2020, all of which are hereby incorporated by reference herein in their entirety.

FIELD OF THE INVENTION

The present invention relates generally to the field of decorative wall coverings. More specifically, the present disclosure relates to systems and methods to provide wall panels with adjustable spacing.

BACKGROUND OF THE INVENTION

Conventional decorative wall coverings, such as stone, brick, or rock wall façade panels, enhance the appearance of buildings and are very popular. Some of the issues with conventional wall panels include the level of difficulty of installation, difficulties in manufacturing and commensurate costs of manufacturing, problems with durability, problems with appearance of the installed products, and the need for adequate spacing between the panel and wall or sheathing over the wall to provide adequate air flow and moisture egress. The present subject matter provides solutions for these and a variety of other problems.

SUMMARY

Disclosed herein, among other things, are system, methods and apparatuses for wall coverings with adjustable spacing. One aspect of the present subject matter relates to a concrete wall panel including a mounting system that includes a decorative panel with a flange embedded within the panel, the flange having mounting features providing for a number of ways to mount a plurality of such panels to a wall or other planar surface. The mounting system allows for fasteners to be used to connect the wall panel to a wall and provides a mount that has an air gap to allow for air to flow and for any moisture to pass between the wall inner surface and behind the wall panels.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIG. 3A illustrates an isometric view of a split-stem bumper according to one embodiment of the present subject matter.

FIG. 3B illustrates a bottom view of the split-stem bumper of FIG. 3A according to one embodiment of the present subject matter.

FIG. 3C illustrates a side view of a split-stem bumper of FIG. 3A according to one embodiment of the present subject matter.

FIG. 4A illustrates an example of an isometric view of a bushing, according to one embodiment of the present subject matter.

FIG. 4B illustrates a bottom view of the bushing of FIG. 4A according to one embodiment of the present subject matter.

FIG. 4C illustrates a side view of the bushing of FIG. 4A according to one embodiment of the present subject matter.

DETAILED DESCRIPTION

The present subject matter relates to wall coverings. In various embodiments, the present subject matter comprises a plurality of wall panels configured to be fastened to a wall. In various embodiments each wall panel comprises a decorative element connected to a mounting structure. In various embodiments, the mounting structure is embedded in a cast body that provides a decorative element. In various embodiments different designs are provided to provide an air gap and moisture egress from the panels.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The scope of the present invention is defined by the appended claims, along with the full scope of legal equivalents to which such claims are entitled.

In various embodiments, the mounting structure allows for fasteners to be used to connect the wall panel to a wall and provides a mount that has an air gap to allow for air to flow and for any moisture to pass between the wall inner surface and behind the wall panels. In various embodiments, such fasteners include, but are not limited to, adhesive, screws, nails, rivets, hooks, clips, tabs, Velcro-like connectors magnets, bolts, grooves, and associated counterparts.

In various embodiments, the mounting structure is secured to the decorative element with second fasteners. In various embodiments, such second fasteners include, but are not limited to, adhesive, screws, nails, rivets, hooks, clips, tabs, Velcro-like connectors, magnets, bolts, grooves, and associated counterparts.

In various embodiments the mounting structure is designed so that an overlapping panel mounted above the mounting portion overlaps the mounting portion and the resulting panels are substantially planar. The effect is to provide a relatively continuous wall structure that looks even in appearance and does not reveal isolated panels unless that is desired. In various embodiments an overlap is accommodated by the configuration of the lower portion of the panel and the mounting structure under it. In various embodiments, the mounting structure is designed to be isolated at adjustable distances from the wall to accommodate overlapping structures of different thickness. For example, in various embodiments, the mounting structure serves as a ledge for another panel to rest on. The panel resting on the ledge may include surface features that allow the panel to reside substantially flush in appearance over the mounting structure of the panel beneath it.

Figure 1A:
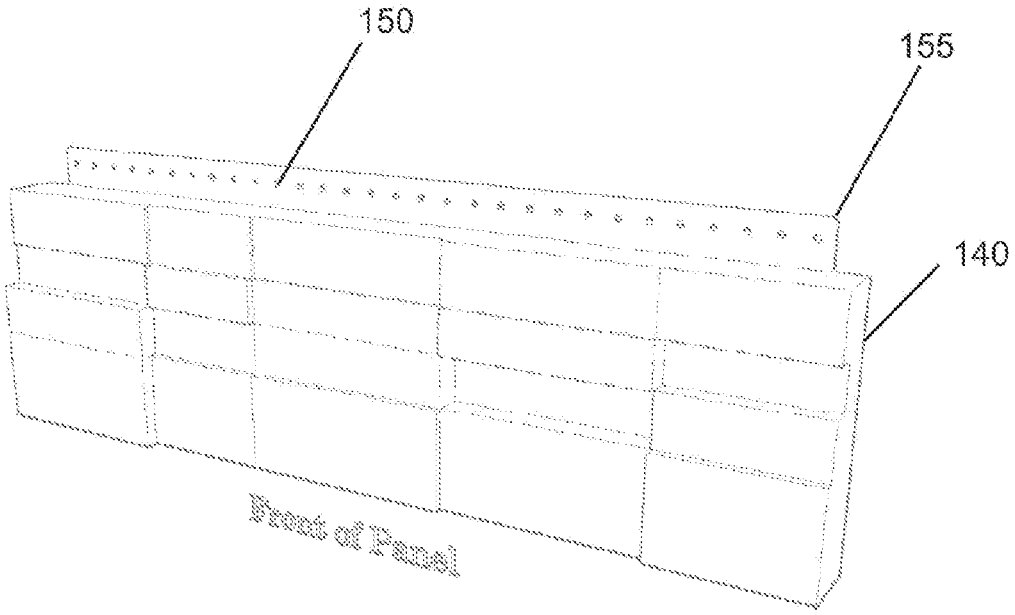
FIG. 1A illustrates a perspective view of a panel in accordance with an example of the present application.

FIG. 1A illustrates a perspective view of a panel in accordance with an example of the present application. FIG. 1A shows one example of a panel of cast material, which includes a decorative feature such as bricks, rocks, or stones. In various embodiments the decorative features may be combined in different combinations. The panel 140 may be made of a variety of materials, including, but not limited to one or more of polymers, plastics, wood, ceramics, concrete or other cementitious material, natural stone, artificial structures, or combinations thereof. The panel 140 includes a flange 155 or other mounting structure which may include one or more materials, such as metal, plastic, rubber, polymer, wood, ceramics, concrete or other cementitious material, or combinations thereof.

In the embodiment of FIG. 1A, a flange design for mounting the panel is connected to a concrete siding panel. In the embodiment shown, the flange 155 is planar above the concrete panel and includes a plurality of holes 150 for mounting the panel 140.

In various embodiments, the flange 155 is a metal strip that is bent and placed in a mold so that a cast decorative component can adhere to the strip. Such a strip may have a bend to enhance purchase. Such strip may have features such as bumps or holes to enhance the connection between the decorative component and the mounting strip.

Figure 1B:
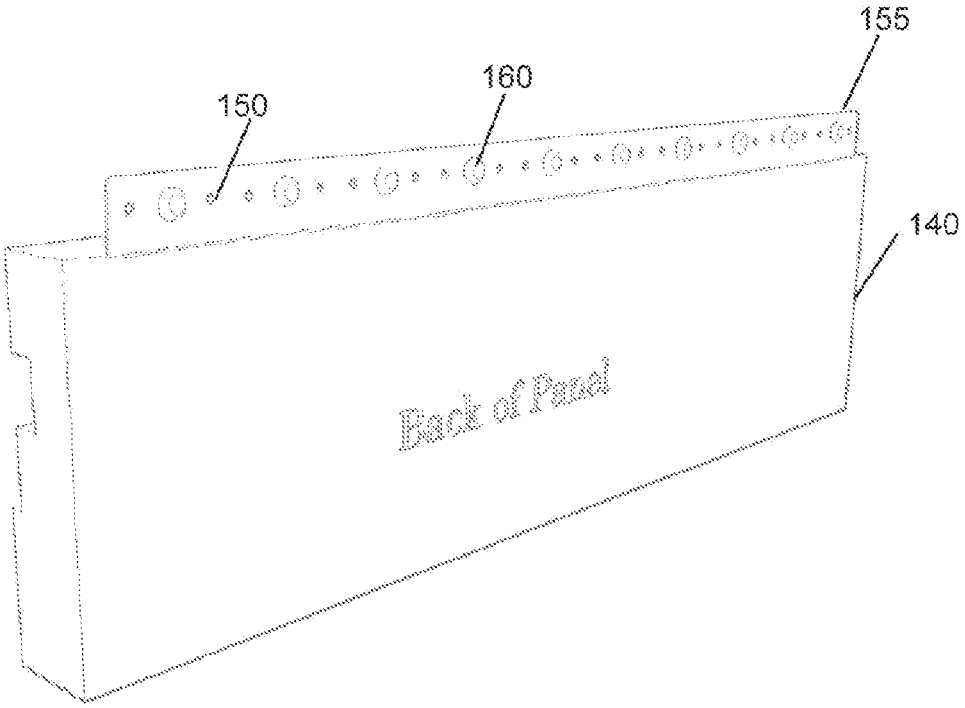
FIG. 1B illustrates a back view of the panel of FIG. 1A, in accordance with an example of the present application.

FIG. 1B illustrates a back view of the panel 140 of FIG. 1A, in accordance with an example of the present application. In various embodiments, a spacer 160 is affixed to the flange 155, the flange 155 including a plurality of holes 150 for mounting the panel 140. In some embodiments the spacer 160 is a plastic part that snaps into the flange. In some embodiments, the spacer 160 is a rubber part that inserts into the flange. In some embodiments the spacer 160 is adhered to the flange with a fastener, such as a glue or other adhesive. In various embodiments, the panels 140 are connected to the wall by fastening the panel to the wall using nails, screws, rivets, or other fasteners.

Figure 2A:
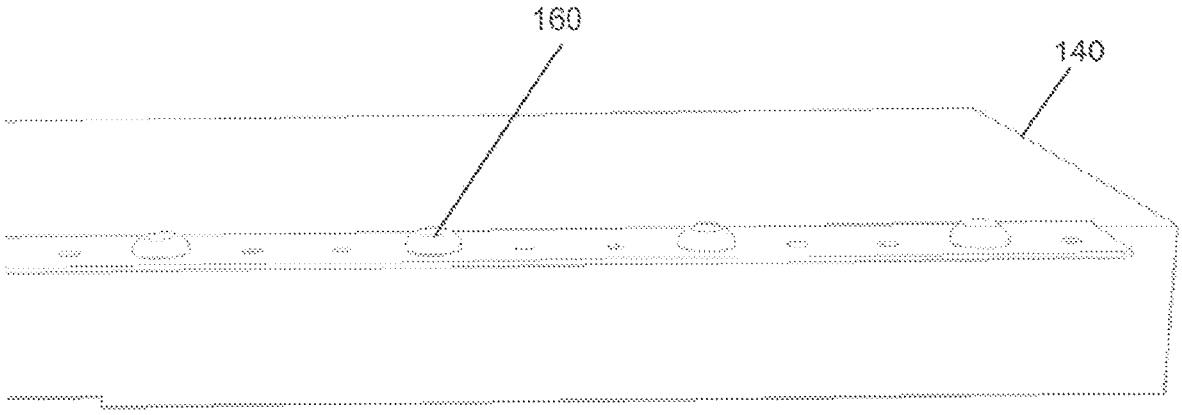
FIG. 2A illustrates a top view of a wall covering, in accordance with at least one example of the present application.

FIG. 2A illustrates a top view of a wall covering of FIG. 1A, in accordance with at least one example of the present application. The wall covering includes a panel 140 and a flange including one or more spacers 160. In various embodiments, the panels 140 are connected to the wall by fastening the panel to the wall using nails, screws, rivets, or other fasteners.

Figure 2B:
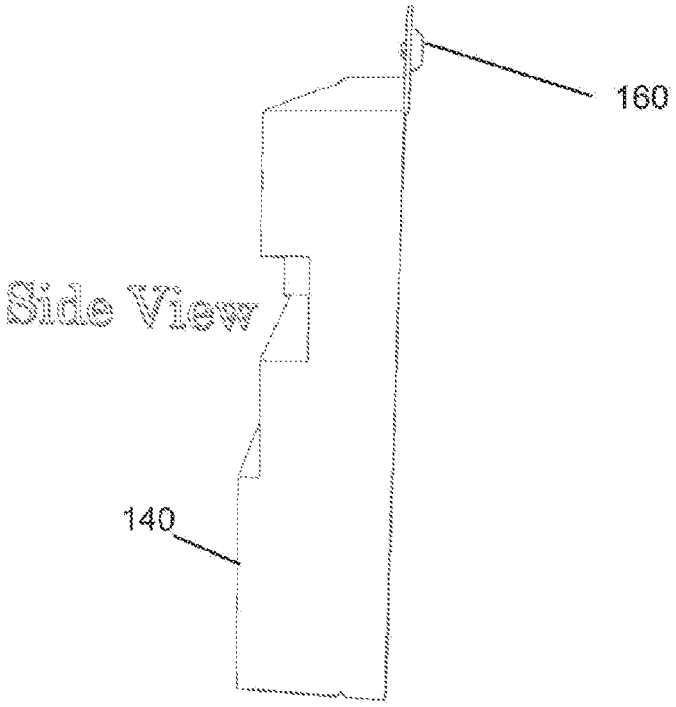
FIG. 2B illustrates a side view of the panel of FIG. 1A, in accordance with an example of the present application.

FIG. 2B illustrates a side view of the panel 140 of FIG. 1A, in accordance with an example of the present application. The panel 140 includes a flange having one or more spacers 160. In some embodiments the spacer 160 is a plastic part that snaps into the flange. In some embodiments, the spacer 160 is a rubber part that inserts into the flange. In some embodiments the spacer 160 is adhered to the flange with a fastener, such as a glue or other adhesive.

FIG. 3A illustrates an isometric view of a split-stem bumper according to one embodiment of the present subject matter. The split-stem bumper may be an embodiment of the spacer 160 depicted in FIGS. 1B-2B. FIG. 3B illustrates a bottom view of the split-stem bumper of FIG. 3A. The split-stem bumper includes an outer diameter A and an inner diameter D, in the depicted embodiment. FIG. 3C illustrates a side view of a split-stem bumper of FIG. 3A. The split-stem bumper has depth B for insertion into a flange, and includes a stem width C for retention once inserted into an opening in the flange. The split-stem bumper has a protrusion distance E, which can be selected to provide for more or less relief from a wall when mounting, in various embodiments.

In various embodiments, a spacer 160 is affixed to the flange 155 shown in FIGS. 1A-2B. The split-stem bumper can be a spacer 160 or a part that snaps into or otherwise engages the flange. Various types of bumpers having different materials may be used including, but not limited to rubbers, plastics, elastomers, ceramics, and combinations thereof. Details of one example of a split-stem bumper are found at: https://voltplastics.com/products/details/350/split-stem-bumper which is herein incorporated by reference in its entirety.

Additional spacers 160 may include bushings. FIG. 4A illustrates an example of an isometric view of a bushing. The bushing has an inner diameter that is smaller than the outer diameter, and the inner diameter is selected to fit an opening in the flange in various embodiments. FIG. 4B illustrates a bottom view of the bushing of FIG. 4A. The bushing includes thru-tabs to retain the bushing when inserted into an opening in the flange, in some embodiments. FIG. 4C illustrates a side view of the bushing of FIG. 4A, illustrating example dimensions of the bushing for use as a spacer in the flange. In one embodiment, the bushing is designed with an outer diameter of 0.5 inches and an inner diameter of 0.175 inches.

In various embodiments, a spacer is affixed to the flange shown in FIGS. 1A-2B. In various embodiments, the spacer is a bushing, such as the BSH-2923 Bushing sold by Volt Industrial Plastics shown in FIGS. 4A-4C.

Figure 5:
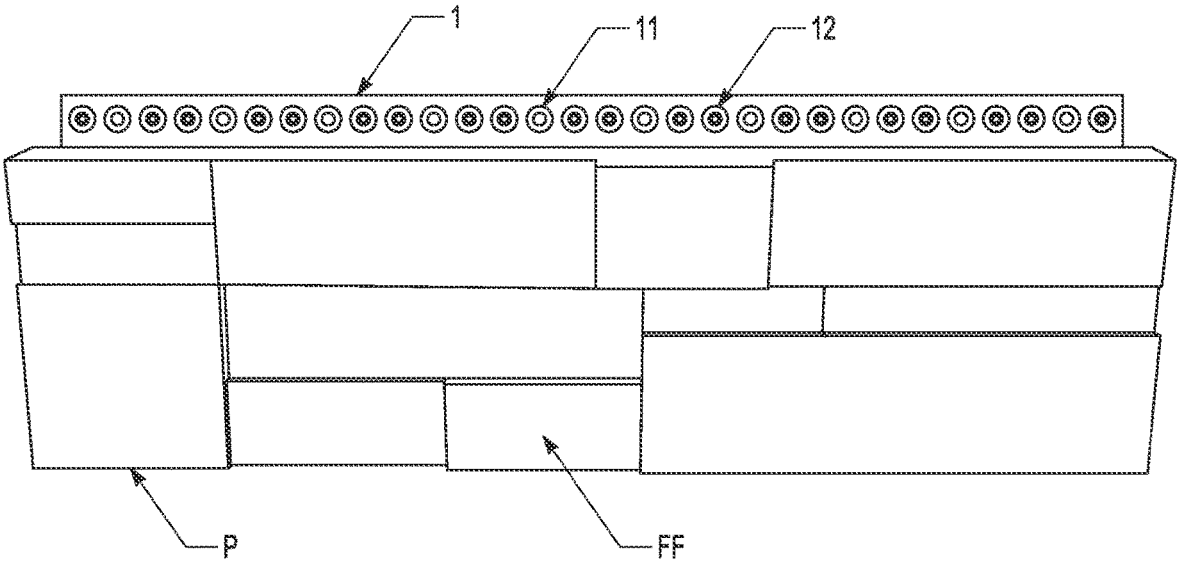
FIG. 5 illustrates a front view of a siding panel including an embedded mounting flange, according to an embodiment of the present subject matter.

FIGS. 5-11 show various perspective views of a siding panel according to another embodiment of the present subject matter. In FIG. 5, the siding panel P includes an embedded mounting flange 1, which can be connected to the panel P using a variety of connections, such as molding, embedding, fasteners, glues, and combinations thereof. FIG. 5 shows a front face (FF) of the panel. In various embodiments, the mounting flange 1 has standoffs 11 which ensure that the flange is separated from the wall to which the panel is mounted by at least the height of the standoff 11. The standoffs 11 may be constructed of a spacer or bushing to serve as a standoff or may be an indentation in the mounting flange 1 configured to provide a consistent separation of the mounting flange 1 from the wall. Those of skill in the art will appreciate that other standoff designs may be employed without departing from the scope of the present subject matter.

In various embodiments, the flange 1 also includes receivers 12 for receiving fasteners. In various embodiments, the receivers 12 are separate from the standoffs and include a hole for a fastener, such as a nail, screw, bolt, or other fastener. In various embodiments, the receivers are smaller in profile than the standoffs so that the gap formed by the panel to the wall which it is connected to will be provided entirely by the standoffs and not by the receivers. The present design allows for fasteners that also have a gap between the wall board to which the panel attaches and the receiver 12 and fastener. The standoffs allow for water to drip down the outside edge of the wall to which the panel is fastened to with a minimal amount of contact to the wall by the standoffs. In various embodiments, the thickness of the standoffs allows for stacking of the panels over each other to align as connected to the wall to form a planar surface. Judicious placement of the receivers 12 enable fastening to a variety of wall materials, such as studs or other structures.

Figure 6:
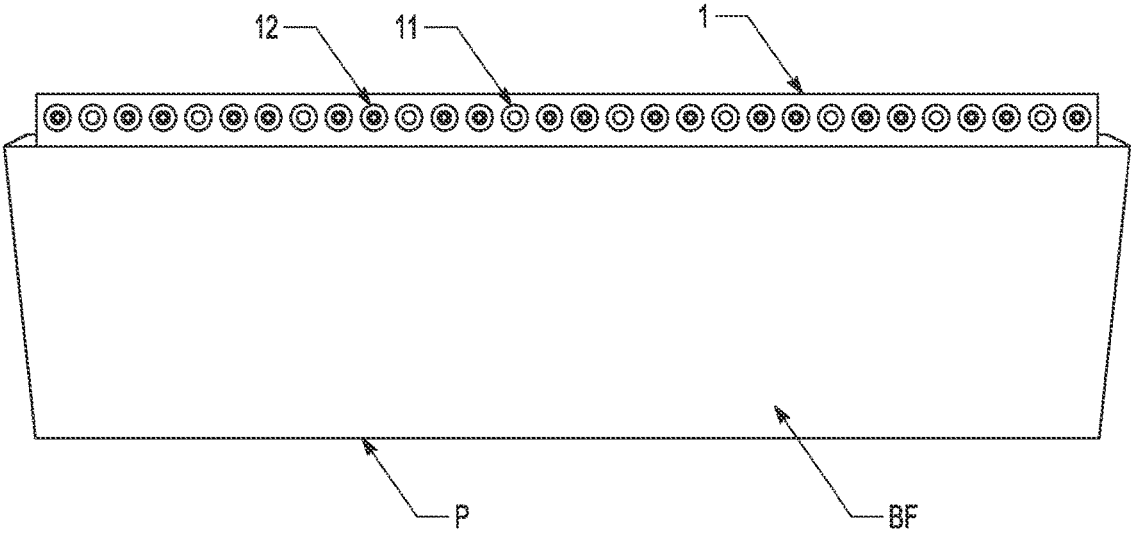
FIG. 6 illustrates a back view of the siding panel of FIG. 5, according to one embodiment of the present subject matter.

FIG. 6 shows a back side of the panel P (back face BF) according to one embodiment of the present subject matter. FIG. 6 shows that the receivers 12 in this embodiment are separate from the standoffs 11 of flange 1.

Figure 7:
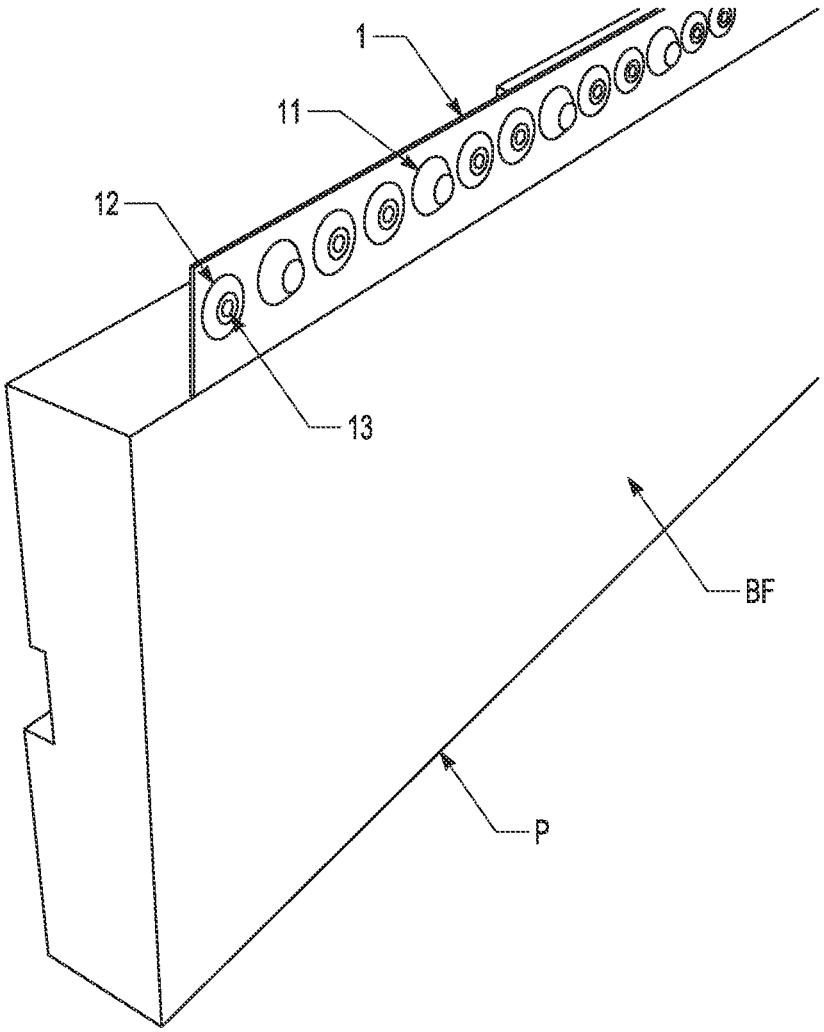
FIG. 7 illustrates a perspective view of the siding panel of FIG. 5 from the back face, according to one embodiment of the present subject matter.

FIG. 7 shows a perspective view of the panel P from the back face. The standoffs 11 have a greater thickness than the receivers 12, so that the standoffs provide a gap between the flange 1 and the wall to which the panel is attached.

Figure 8A:
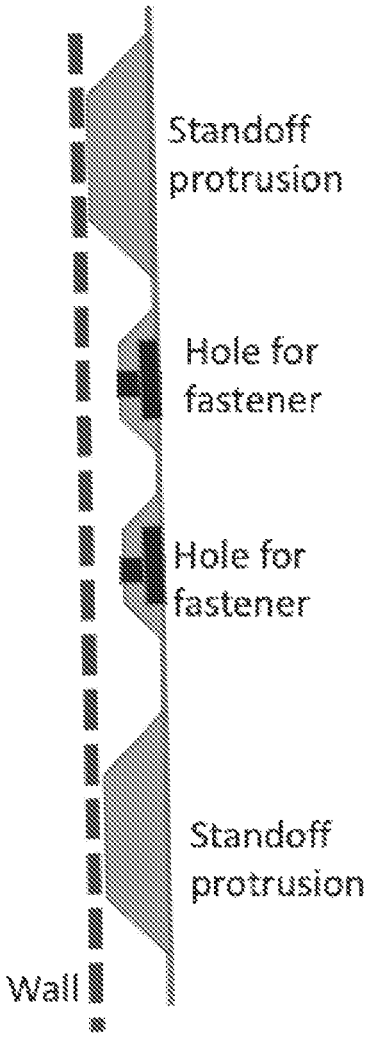
FIGS. 8A-8B illustrate top views of the mounting flange of FIG. 5, according to various embodiments of the present subject matter.
Figure 8B:
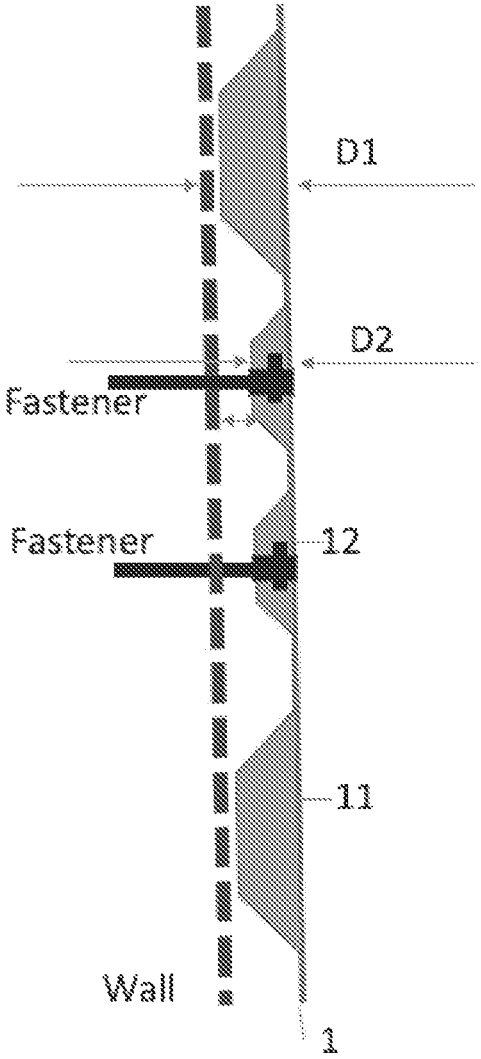

This extra thickness of the standoffs 11 as compared to the receivers 12 is demonstrated in FIGS. 8A and 8B.

In various embodiments the standoffs 11 allow for the fasteners to have an air gap around them and between the wall and the receivers 12. In various embodiments, the receivers 12 include an accommodation of the heads of the fasteners in the form of a recess to receive a head of a fastener. This allows a flush surface of flange 1 so that overlapping panels can rest on the flange and not protrude due to the fasteners.

Figure 9:
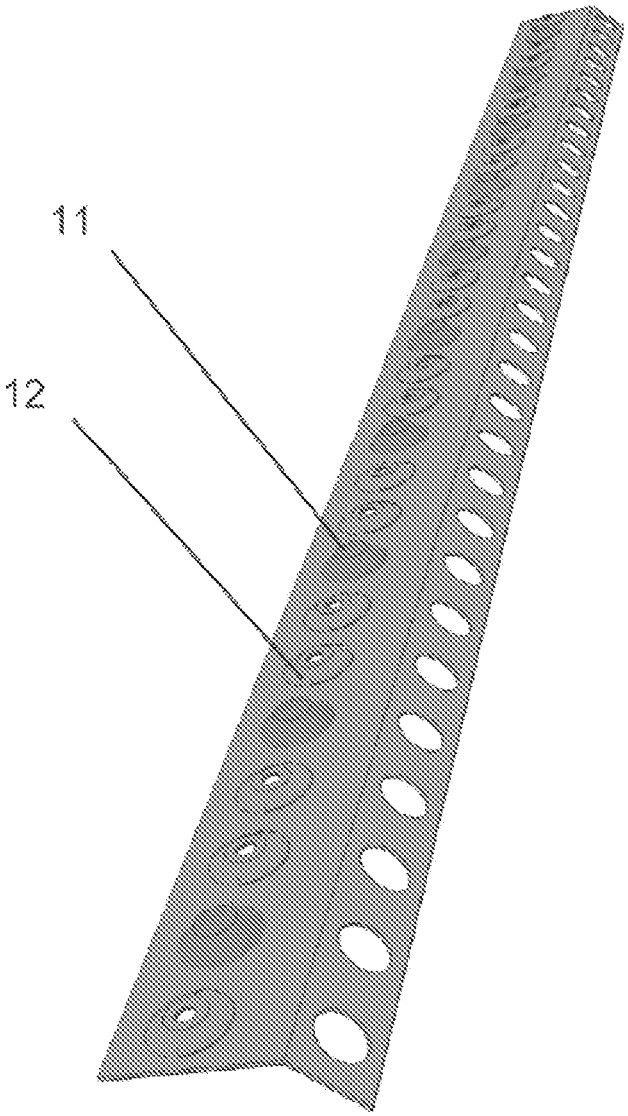
FIGS. 9-11 illustrate perspective views of the mounting flange of FIG. 5, according to various embodiments of the present subject matter.
Figure 10:
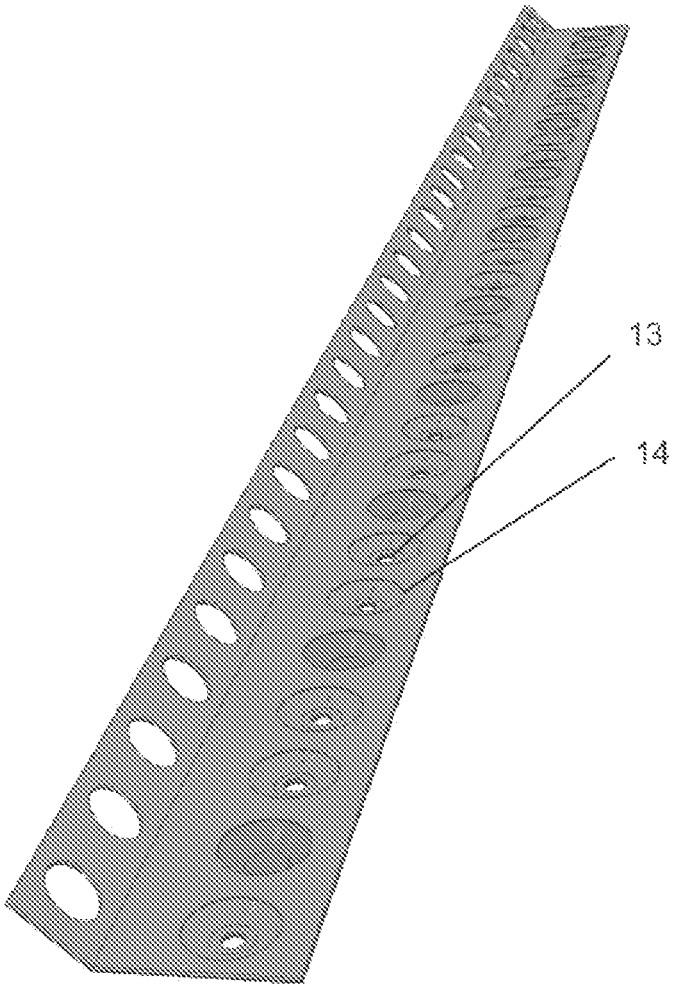
Figure 11:
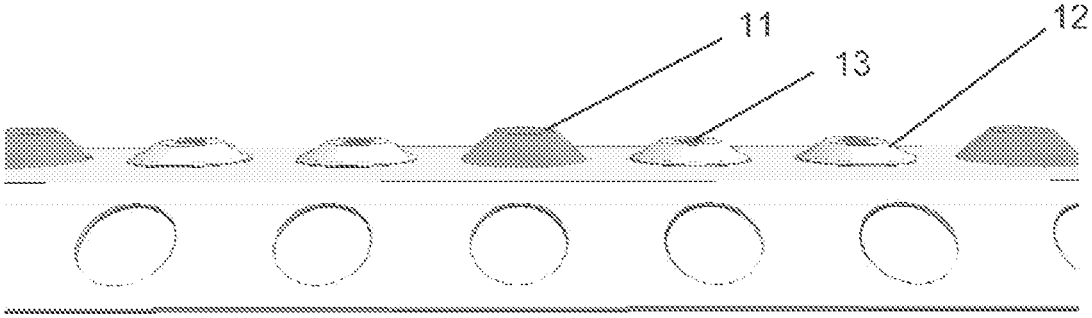

Further details of the flange according to one embodiment are provided by FIGS. 9-11. FIGS. 9-11 illustrate perspective views of the mounting flange of FIG. 5, according to various embodiments of the present subject matter. In FIG. 9, several standoffs 11 and receivers 12 are shown on a portion of the flange. FIG. 10 shows an opposite side of the flange, having several bores 13 and recesses 14. FIG. 11 provides a further view of the flange, showing relative positions of standoffs 11, receivers 12 and bores 13.

As shown in FIGS. 5-11, in various embodiments, the siding panel P may include a front-face FF, a back-face BF, a mounting flange 1, standoffs 11, receivers 12, bores 13, and recesses 14.

The siding panel P may be a cast veneer siding panel. The front-face FF may be a front, a visual, or an otherwise outwardly facing surface of the panel P. The front-face FF may include one or more design elements, which can, for example, include a variety of shapes, colors and textures. The back-face BF may a back, a non-visual, or an otherwise inwardly facing surface of the panel P. The back-face BF may include a natural finish from a manufacturing process. The natural finish may, for example, be a rough surface which includes various particle sizes and colors.

The mounting flange 1 may be imbedded in cast veneer of the siding panel (P). The mounting flange 1 may include the standoffs 11. The standoffs 11 may be a series of embossments, indentations, or protrusions extending outwardly from a surface of the mounting flange 1. A plurality of the standoffs 11 may be individually formed along a length of the mounting flange 1. The standoffs 11 may be configured to extend toward a substrate surface when the mounting flange 1 is coupled to a substrate wall. The substrate wall may be an exterior wall of a residential home or a variety of other buildings.

The standoffs 11 may thereby create a consistent standoff gap between the back-panel BF of the siding panel P, and an exterior wall of a residential home or other types of buildings. The positive standoff gap may allow for air to flow and moisture to pass between the back-face BF and a substrate wall. The standoff gap may also create a positive drainage plane. The standoffs 11 on each mounting flange 1 may reduce contact with a substrate wall by 66%; and may increase positive air flow by 3.2%. Those of skill in the art will appreciate that other benefits may be achieved with the inventive subject matter described herein.

The standoffs 11 may include a variety of dimensions. For example, each of the standoffs 11 may have, but are not limited to, an approximate diameter of 0.812" at a base of each standoff, and an approximate diameter of 0.50" at a peak of each standoff, and an approximate height of 0.114", or 0.172". The height, shown in FIG. 8 as D1, can be measured as the distance each of the standoffs 11 extend outwardly from the back-face BF of the mounting flange 1. The height of the standoffs 11 may thereby define the size of the standoff gap between the back-face BF and a substrate wall, when the mounting flange is coupled to a substrate wall.

The receivers 12 of the flange 1 may be a series of indentations or protrusions extending outwardly from a surface of the mounting flange 1. In various embodiments, spacers may be employed. The receivers 12 may be configured as fastener-receiving indentations, in order to receive heads of various fasteners when the mounting flange 1 is coupled to a wall. The receivers 12 may be configured to receive a #8 K-lath screw. For example, the receivers 12 may have, but are not limited to, an approximate diameter of 0.812", at a base, and an approximate height of 0.060-0.62". The height of the receivers 12, shown in FIG. 8B as D2, may be measured as the distance each of the receivers 12 extend outwardly from the back-face BF of the mounting flange 1. Each of the receivers 12 may include a bore 13. The bores 13 can be an opening configured to allow screws or other types of fasteners, to pass through the mounting flange 1, to couple the siding panel to a substrate surface.

The receivers 12 may also include one or more corresponding recesses 14 on the front-face FF of the mounting flange 1. The recesses 14 can be configured to receive the head of a screw or other fastener. For example, a recess having a height of 0.036" may be formed on the front-face FF of the mounting flange 1, to compensate for the height of a screw head, such as a #8 K-lath screw head. The recesses 14 can thereby allow a screw head to be recessed or to sit flush with the mounting flange 1, when the mounting flange 1 is coupled to a substrate wall. This allows a panel above the flange to overlap it and not be forced out by the heads of the fasteners (e.g., K-lath screws).

During the installation of at least one example of a siding panel P, the mounting flange 1 may be positioned against a substrate surface (or wall), in preparation for mounting. A plurality of fasteners, such as screws, can be positioned within each of the bores 13 of the receivers 12. The screws can then be driven into the substrate wall; until the each of the standoffs 11 contact the substrate wall. The standoffs 11 are configured to have a greater height than the receivers 12, such that the standoffs 11 define a standoff gap between the back-face BF of the siding panel and the substrate wall. When the screws are driven into the substrate surface, the recesses 14 of each of the receivers 12 receive the heads of the screws, or other fasteners, such that the heads are level, or flush with, a surface of the mounting flange 1.

Figure 12:
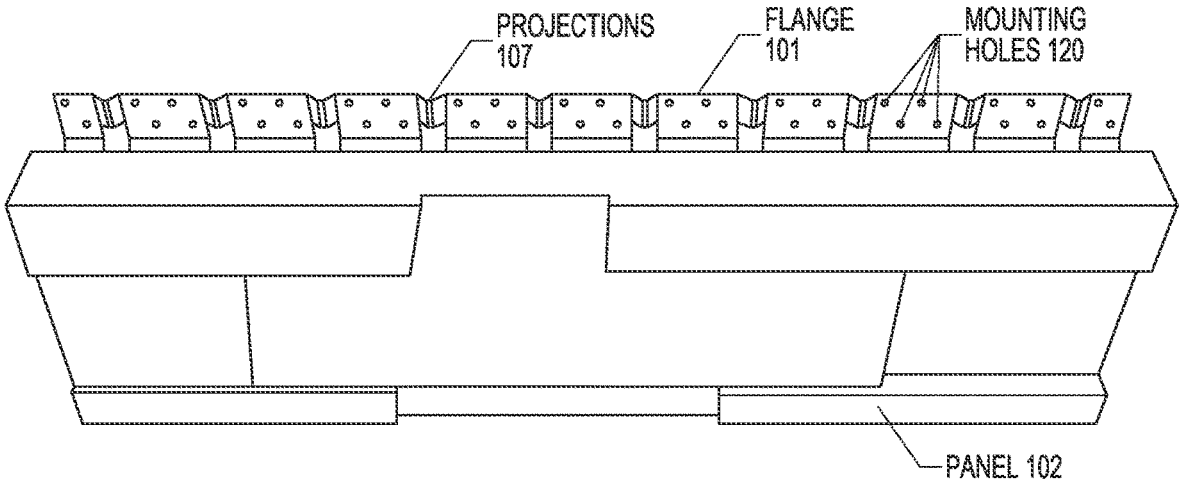
FIG. 12 illustrates a panel with a flange embedded in the panel, according to an embodiment of the present subject matter.

Various other embodiments of a fastening system are shown in the following figures. FIG. 12 shows one embodiment a panel 102 with a flange 101 embedded in the panel. The panel 102 is mounted using mounting holes 120 with fasteners, including, but not limited to, adhesive, screws, nails, rivets, hooks, clips, tabs, Velcro-like connectors, magnets, bolts, grooves, and associated counterparts. The flange 101 includes projections 107 that can be used to provide a surface for another panel to rest on.

Figure 13:
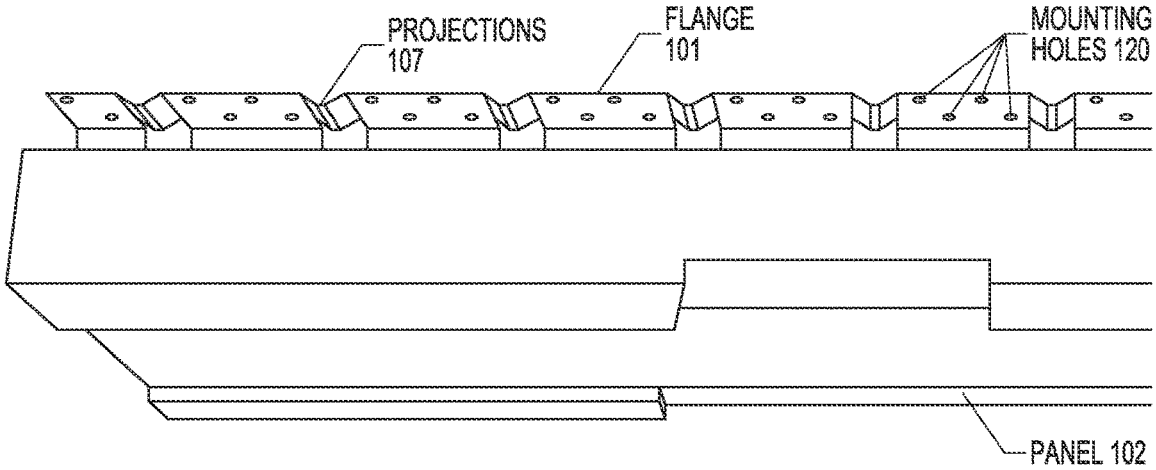
FIG. 13 illustrates a top view of the panel of FIG. 12 according to one embodiment of the present subject matter.

A top view of the panel of FIG. 12 is provided in FIG. 13 according to one embodiment of the present subject matter. In various embodiments, the flange 101 is molded in panel 102 with a portion extending from the panel and providing contact to the nailing portions where the mounting holes 120 are provided for attachment to a wall or other structure.

Figure 14:
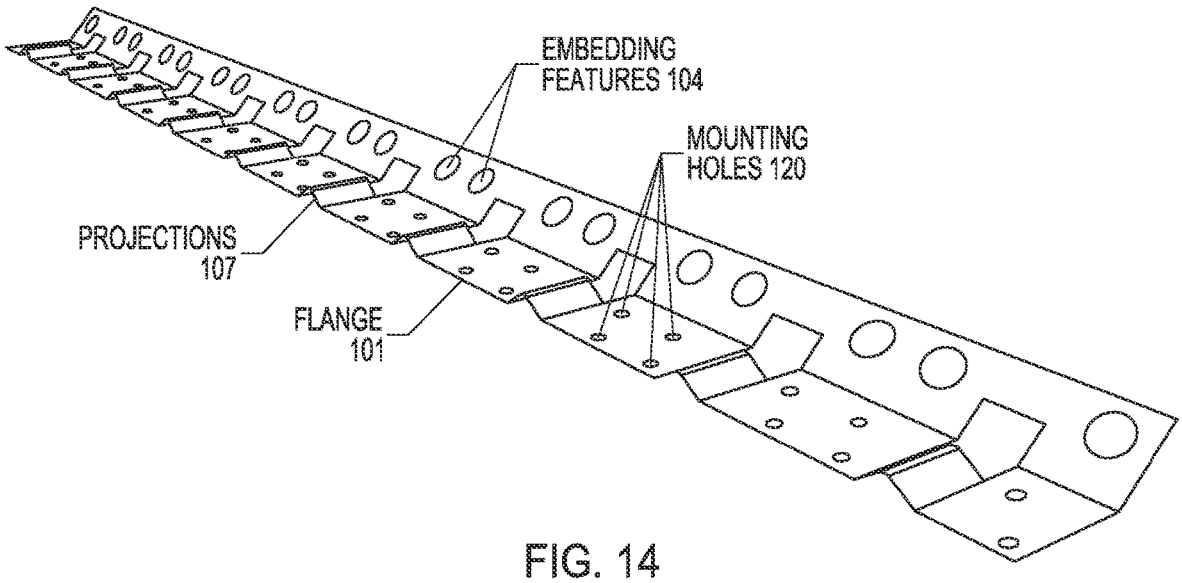
FIG. 14 illustrates a perspective view of the flange of FIG. 12 according to one embodiment of the present subject matter.

A perspective view of the flange is provided in FIG. 14 according to one embodiment of the present subject matter. The flange 101 has a nailing strip portion that has several mounting holes 120 and resides against the wall or other planar structure that the panel 102 is mounted to. The flange 101 also has embedding features 104 as shown in FIG. 14. It is understood that the embedding features 104 may be holes, as demonstrated by the figure. The embedding features 104 can also be protrusions, bumps, perforations or other structures that are provided to enhance bonding and connection of the material of panel 102 to the flange 101. Those of skill in the art will appreciate that other geometries and structures may be used without departing from the scope of the present subject matter.

In various embodiments, the planar portion of flange 101 that mounts against the wall or other structure is provided at a 45 degree angle to the portion embedded in the wall panel 102. Other angles may be employed, including, but not limited to, 15, 20, 25, 30, 35, 40, 50, 55, and 60 degrees. Those of skill in the art will appreciate that the features of flange 101 can be made using metal bending and stamping technologies as a single piece. In various embodiments, the projections 107 include an opening to facilitate metal fabrication. In various embodiments the projections 107 provide open channels that allow for drainage. The projections may terminate in an opening as demonstrated in FIG. 14. An opening at the top of the projection 107 (which is triangular when placed against a flat wall) allows water to flow behind the projection 107. An opening at the bottom of each projection 107 is shown as a cut out square and may allow water to follow the wall or sheathing material down the wall to provide for drainage. Other types of projections, including, but not limited to fins, bumps or other structures (e.g., such as spacers) may be employed without departing from the present subject matter.

In various embodiments, the flange is made out of metal. It is understood that other materials may be employed, such as plastic, rubber, without departing from the present subject matter.

Figure 15:
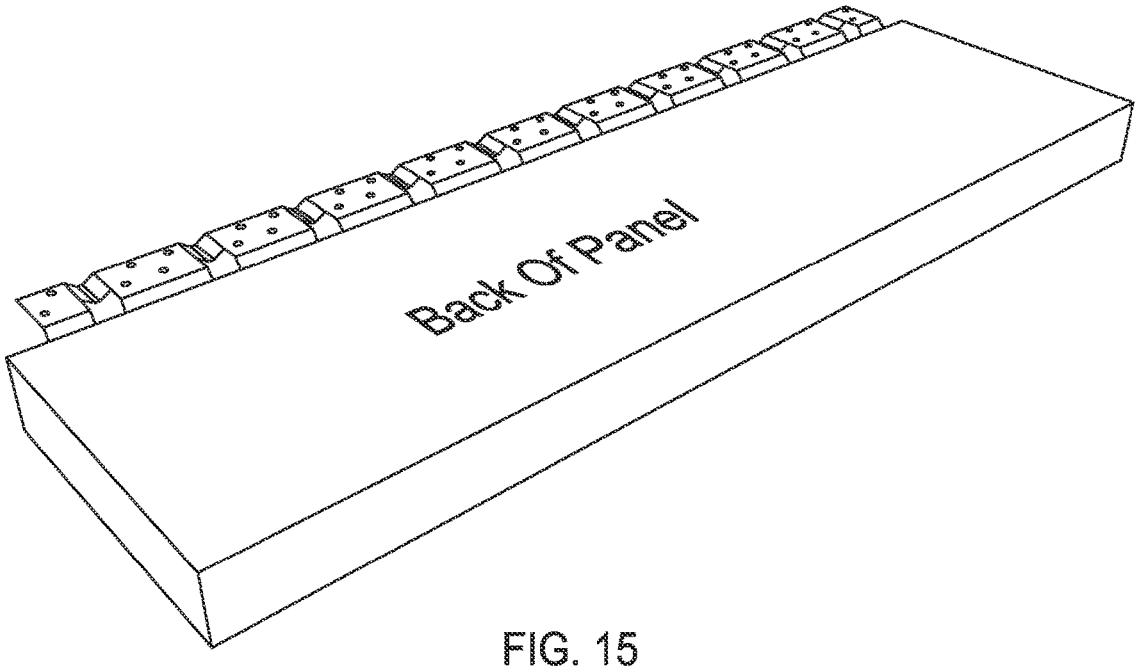
FIG. 15 illustrates a back surface of the panel of FIG. 12 according to one embodiment of the present subject matter.

FIG. 15 shows a back surface of the panel 102 according to one embodiment of the present subject matter. In various embodiments, the bottom of the panel is configured to rest against projections 107 of an adjoining panel. In the example shown, the bottom of the panel has a flat section to rest against the protrusions 107; however, it is understood that other structure may be molded into the panel or attached to the panel to provide a mount over an adjacent panel.

Figure 16:
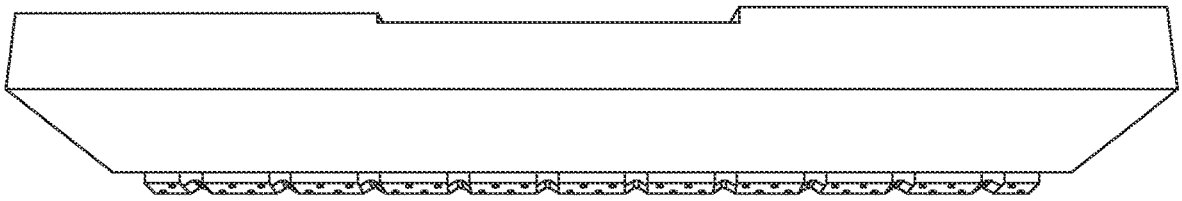
FIG. 16 illustrates a bottom view and bottom surface of the panel of FIG. 12 according to one embodiment of the present subject matter.

FIG. 16 illustrates a bottom view and bottom surface of the panel of FIG. 12 according to one embodiment of the present subject matter. In various embodiments, the bottom surface of the panel is configured to rest on or over an adjoining panel. In the example shown, the bottom of the panel has a flat section; however, it is understood that other structure may be molded into the panel or attached to the panel to provide a mount on an adjacent panel.

Figure 17:
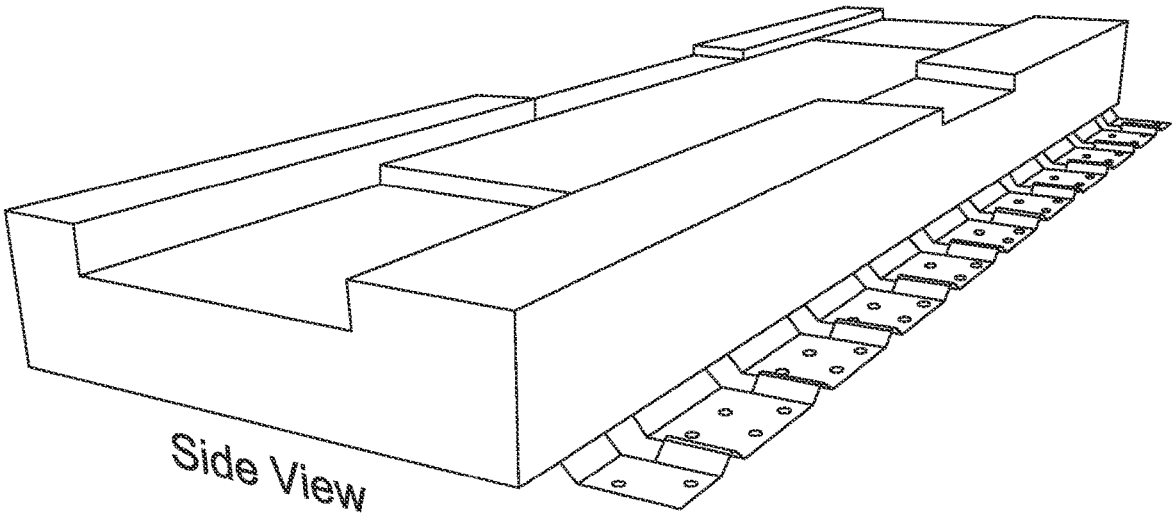
FIG. 17 illustrates a side view and side surface of the panel of FIG. 12 according to one embodiment of the present subject matter.

FIG. 17 illustrates a side view and side surface of the panel of FIG. 12 according to one embodiment of the present subject matter. In various embodiments, the side surface of the panel is configured to be positioned adjacent an adjoining panel. In the example shown, the side of the panel has a flat section reflecting the structure of the decorative façade of the panel 102; however, it is understood that other structure may be molded into the panel or attached to the panel to mount to or with an adjacent panel.

Figure 18:
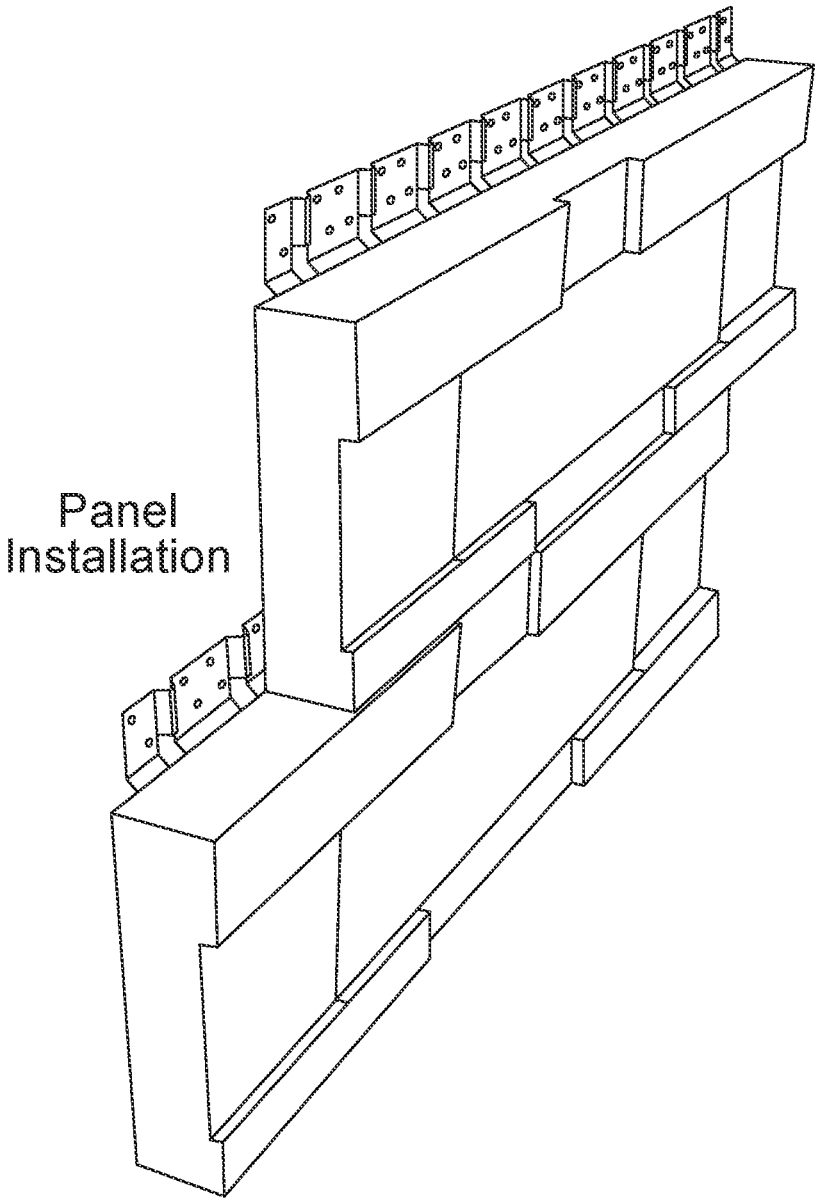
FIG. 18 illustrates a perspective view of multiple panels of FIG. 12 installed adjacent to each other according to one embodiment of the present subject matter.

FIG. 18 shows a perspective view of multiple panels 102 installed adjacent to each other according to one embodiment of the present subject matter. A person of ordinary skill would appreciate that the present subject matter allows for more complicated installations based on the pattern, texture, colorization, and types of decorative panels 102. In various embodiments, the panels are made of cast material, which includes a decorative feature such as bricks, rocks, or stones. In various embodiments the decorative features may be combined in different combinations. The panel may be made of a variety of materials, including, but not limited to one or more of polymers, plastics, wood, ceramics, concrete or other cementitious material, natural stone, artificial structures, or combinations thereof. The panel includes a flange or other mounting structure which may include one or more materials, such as metal, plastic, rubber, polymer, wood, ceramics, concrete or other cementitious material, or combinations thereof.

Figure 19:
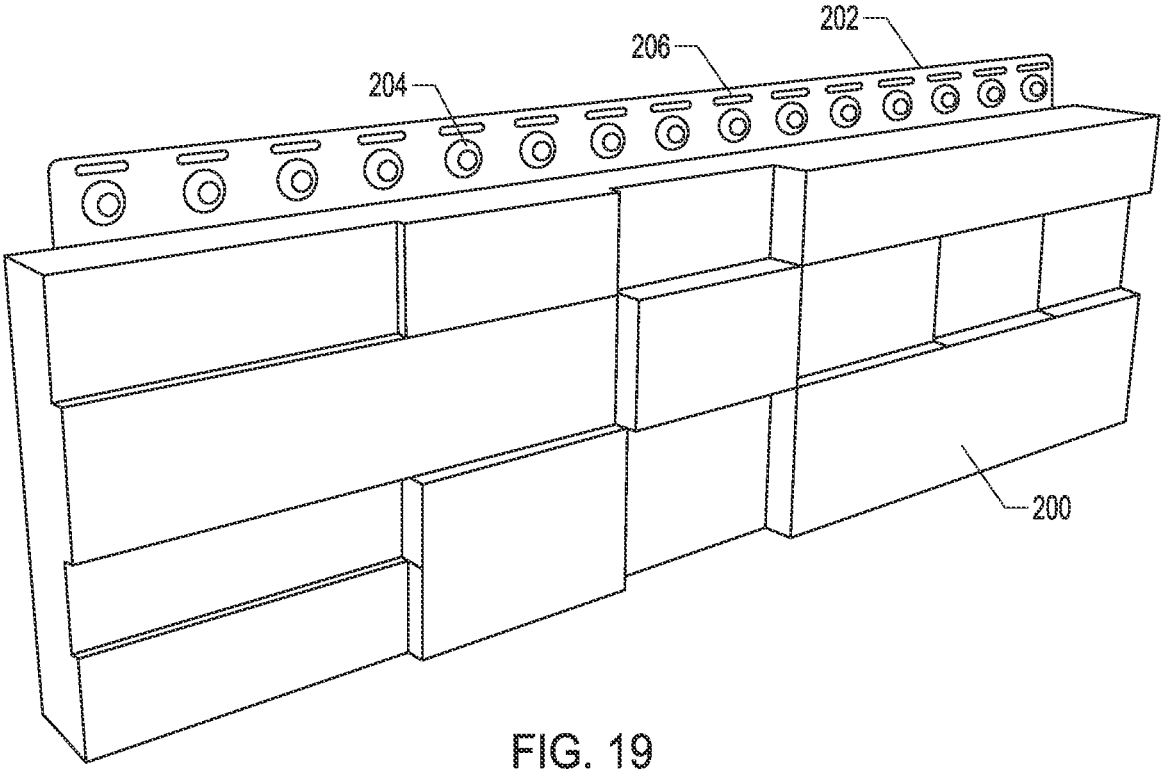
FIG. 19 illustrates a front view of a siding panel including an embedded mounting flange, according to an embodiment of the present subject matter.

FIG. 19 illustrates a front view of a siding panel including an embedded mounting flange, according to an embodiment of the present subject matter. FIGS. 19-25 use consistent reference numerals to clarify the depicted embodiments. The siding panel 200 includes a flange 202 configured to be partially embedded within the panel. The flange 202 includes mounting holes 206 and protrusions 204, the protrusions extending toward the front of the panel 200.

The siding panel of FIG. 19 may be mounted using mounting holes 206 with fasteners, including, but not limited to, adhesive, screws, nails, rivets, hooks, clips, tabs, Velcro-like connectors, magnets, bolts, grooves, and associated counterparts. The flange 202 includes protrusions 204 that can be used to provide a surface for another panel to rest on.

Figure 20:
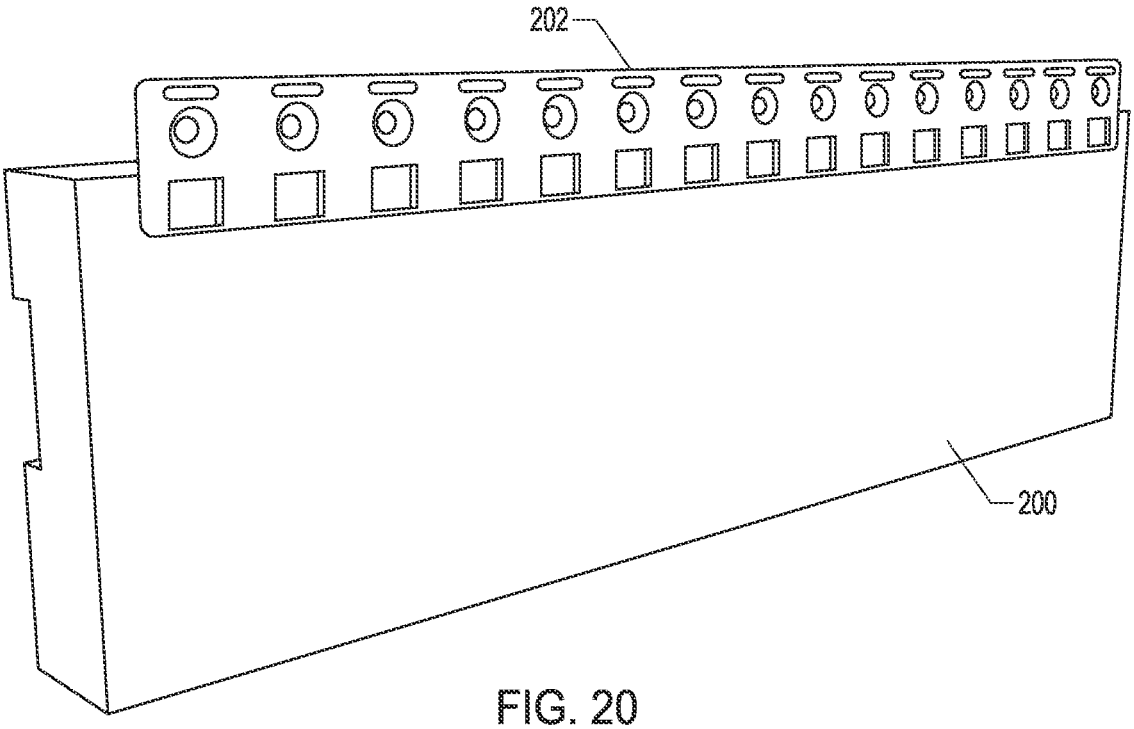
FIG. 20 illustrates a back view of the siding panel of FIG. 19, according to one embodiment of the present subject matter.

FIG. 20 illustrates a back view of the siding panel of FIG. 19, according to one embodiment of the present subject matter. The siding panel 200 is affixed to the flange 202 before mounting to a wall.

Figure 21:
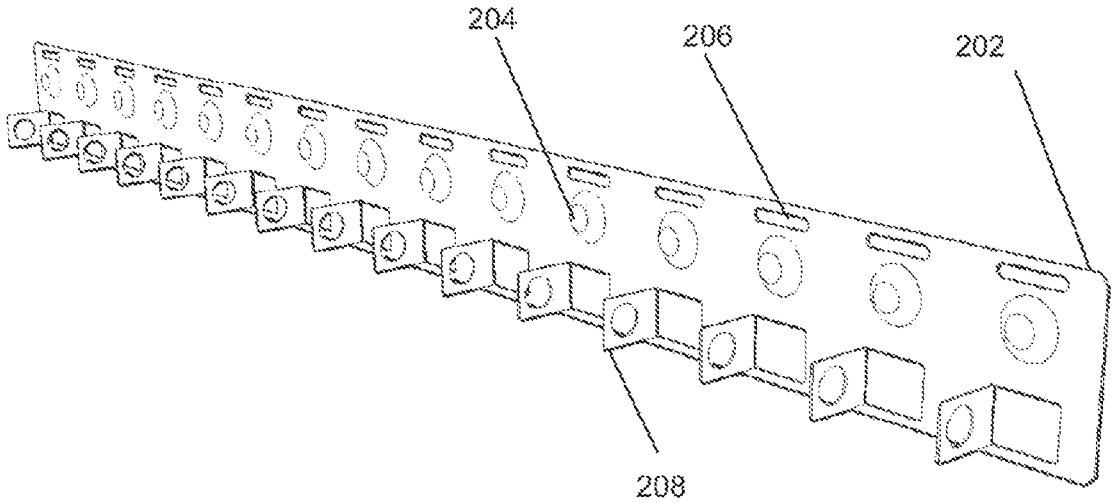
FIG. 21 illustrates a front view of the mounting flange of FIG. 19, according to various embodiments of the present subject matter.
Figure 25:
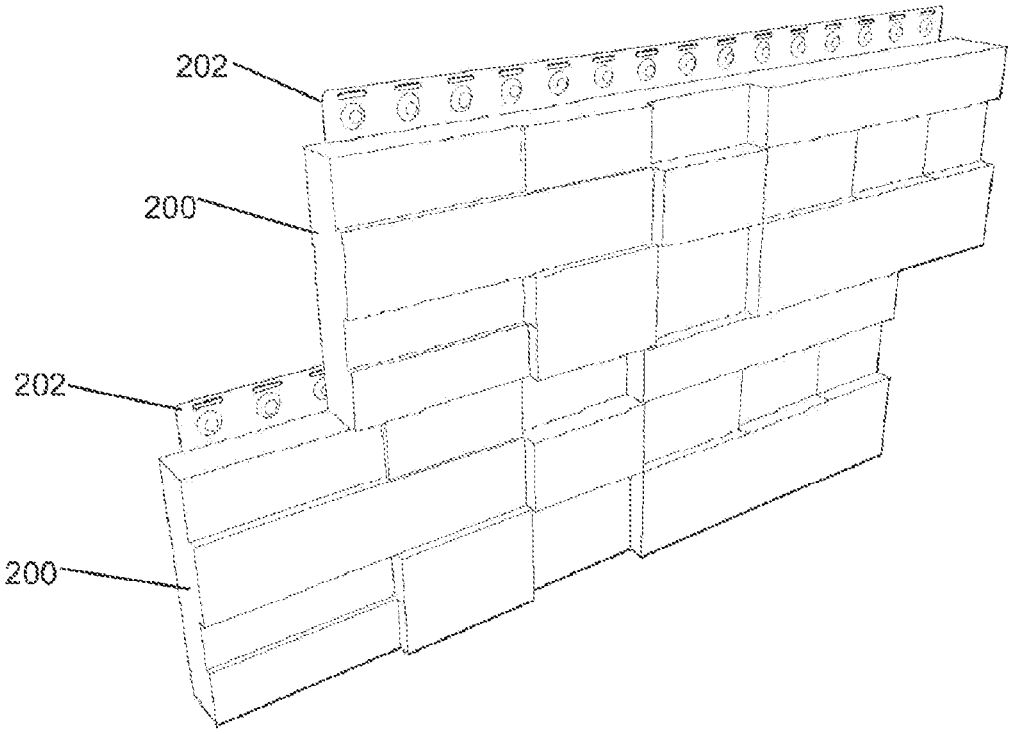
FIG. 25 illustrates a front view of multiple mounted siding panels of FIG. 19, according to various embodiments of the present subject matter.

FIG. 21 illustrates a front view of the mounting flange of FIG. 19, according to various embodiments of the present subject matter. The flange 202 includes a number of mounting features, including protrusions 204, mounting holes 206, and attachment tabs 208, in various embodiments. In one embodiment, a plurality of protrusions 204 are provided on a first side of the flange 202 protruding from the flange towards the siding panel (or decorative panel) 200, the plurality of protrusions 204 configured to provide an offset from the wall for mounting an additional panel above the decorative panel, as shown in FIG. 25. The flange 202 includes plurality of mounting holes 206 flush with the second side of the flange, where the second side of the flange is configured to rest against the wall when mounted, in an embodiment. The flange 202 also includes a plurality of attachment tabs 208 protruding from the first side of the flange in one embodiment, the attachment tabs 208 configured to be embedded within or on a side of a portion of the decorative panel 200. Those of skill in the art will appreciate that the features of flange 202 can be made using metal bending and stamping technologies as a single piece. In various embodiments the protrusions 204 provide separation between the panel and wall that allow for moisture egress or drainage.

In various embodiments, the flange is made out of metal. It is understood that other materials may be employed, such as plastic, rubber, without departing from the present subject matter.

Figure 22:
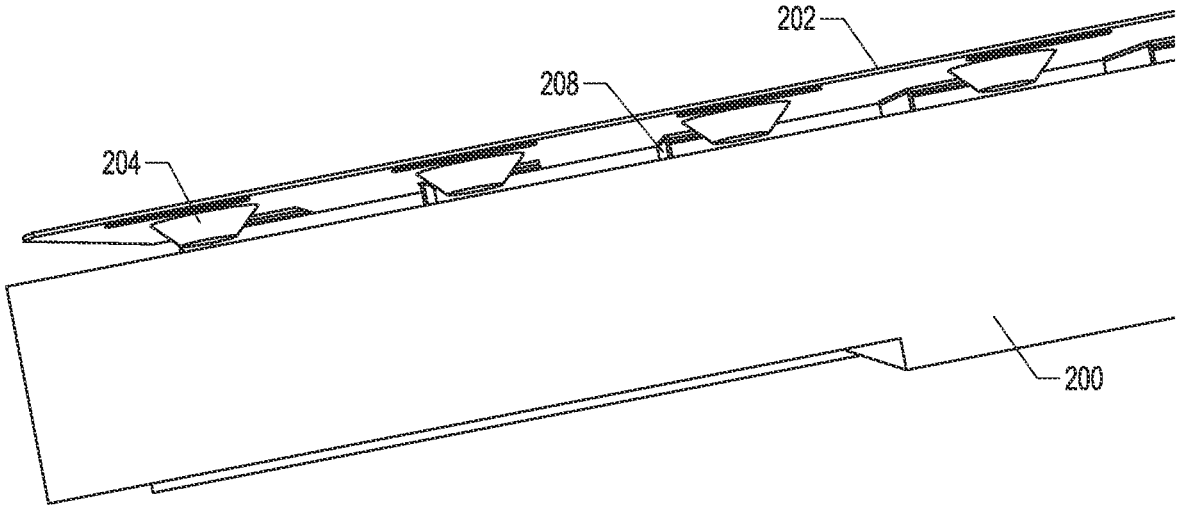
FIG. 22 illustrates a top view of the siding panel of FIG. 19, according to one embodiment of the present subject matter.

FIG. 22 illustrates a top view of the siding panel of FIG. 19, according to one embodiment of the present subject matter. The flange 202 is attached to the panel 200 using attachment tabs 208, which are partially embedded in the panel to provide an offset from the front of the flange 202 to the back of the panel 200. Other types of attachments can be used to attach the flange to the panel without departing from the scope of the present subject matter. The protrusions 204 extend from the front of the flange 202 toward the panel 200 (and away from the wall when mounted), in the depicted embodiment.

Figure 23:
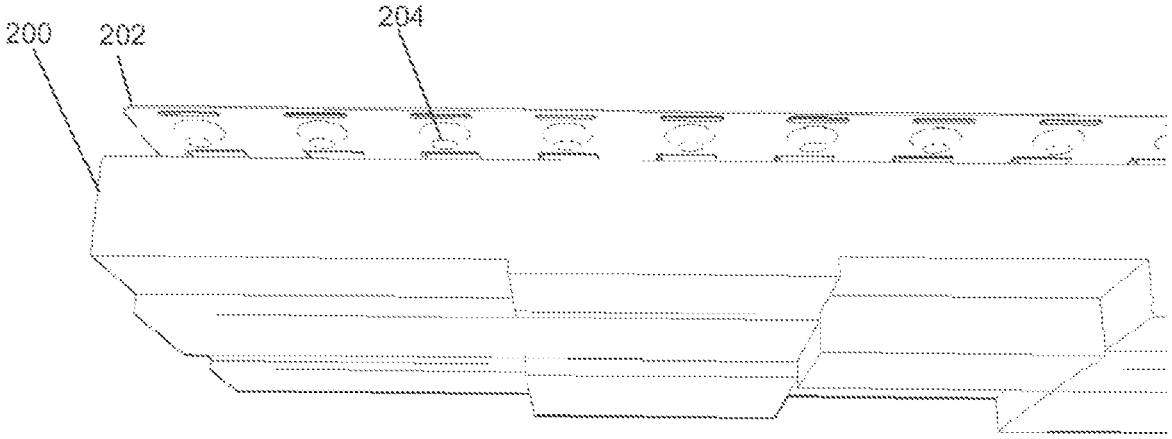
FIG. 23 illustrates a perspective view of a top portion of the siding panel of FIG. 19, according to one embodiment of the present subject matter.

FIG. 23 illustrates a perspective view of a top portion of the siding panel of FIG. 19, according to one embodiment of the present subject matter. A plurality of protrusions 204 are shown extending from the front of the flange 202 toward the panel 200 (and away from the wall when mounted), in the depicted embodiment.

Figure 24:
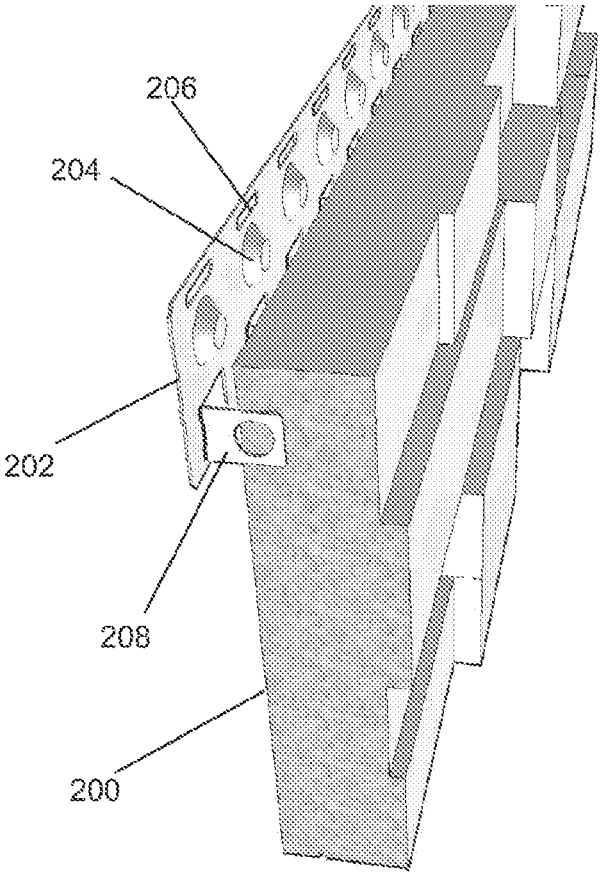
FIG. 24 illustrates a side view of the siding panel of FIG. 19, according to one embodiment of the present subject matter.

FIG. 24 illustrates a side view of the siding panel of FIG. 19, according to one embodiment of the present subject matter. The flange 202 is attached to the panel 200 using attachment tabs 208. While some attachment tabs 208 are partially embedded in the panel, one attachment tab 208 is shown on an end of the panel 200. The protrusions 204 are extending from the front of the flange 202 toward the panel 200 (and away from the wall when mounted), in the depicted embodiment. A gap is provided between the front surface of the flange 202 and the back surface of the panel 200, to provide for moisture egress and air flow in various embodiments.

FIG. 25 illustrates a front view of multiple mounted siding panels of FIG. 19, according to various embodiments of the present subject matter. A lower panel 200 and an upper panel 200 are mounted in an overlapping manner, such that the flange 202 of the lower panel is covered by the bottom portion of the upper panel. The protrusions on the flange of the lower panel push the bottom of the upper panel away from the wall when mounted, providing a gap for moisture egress and air flow in various embodiments. The protrusion can have a thickness which can be selected to provide for more or less relief from a wall when mounting in combination with additional panels, in various embodiments.

A person of ordinary skill would appreciate that the present subject matter allows for more complicated installations based on the pattern, texture, colorization, and types of decorative panels. In various embodiments, the panels are made of cast material, which includes a decorative feature such as bricks, rocks, or stones. In various embodiments the decorative features may be combined in different combinations. The panel may be made of a variety of materials, including, but not limited to one or more of polymers, plastics, wood, ceramics, concrete or other cementitious material, natural stone, artificial structures, or combinations thereof. The panel includes a flange or other mounting structure which may include one or more materials, such as metal, plastic, rubber, polymer, wood, ceramics, concrete or other cementitious material, or combinations thereof.

This application is intended to cover adaptations or variations of the present subject matter. It is to be understood that the above description is intended to be illustrative, and not restrictive. The scope of the present invention should be determined with reference to the appended claims, along with the full scope of legal equivalents to which such claims are entitled.

What is claimed is:

1. A concrete wall panel mounting system for mounting on a wall, the system comprising:

a decorative panel with a flange configured to be partially embedded within the panel, the flange having mounting features including:

a plurality of conical protrusions on the flange protruding from the flange towards the decorative panel, the plurality of protrusions configured to provide an offset from the wall for an additional panel mounted above the decorative panel;

a plurality of mounting holes in the flange, each mounting hole proximal to a respective conical protrusion and the flange material about each mounting hole substantially flush with the wall, wherein the flange is configured to rest against the wall when mounted;

a plurality of attachment tabs protruding from the flange, the attachment tabs configured to be embedded within a portion of the decorative panel, and wherein the decorative panel is configured to be mounted to the wall using at least some of the plurality of mounting holes.

2. The system of claim 1, wherein the decorative panel is configured to be mounted using a fastener configured to pass through each mounting hole of the at least some of the plurality of mounting holes.

3. The system of claim 2, wherein the fastener includes one or more of a screw, a nail, a rivet, a hook, a clip or a tab.

4. The system of claim 1, wherein the plurality of protrusions are configured to be made using a metal bending process.

5. The system of claim 1, wherein the plurality of protrusions are configured to be made using a metal stamping process.

6. The system of claim 1, wherein the plurality of protrusions are configured to provide separation between the panel and the wall to allow for moisture egress or drainage.

7. The system of claim 1, wherein the flange is made from one or more of metal, plastic, or rubber.

8. The system of claim 1, wherein at least one of the plurality of attachment tabs is configured to be attached to an end of the panel.

9. The system of claim 1, wherein the plurality of protrusions are configured to provide more or less relief of a panel mounted to the wall.

10. The system of claim 1, wherein the decorative panel includes one or more of a polymer, a plastic, wood, a ceramic, concrete or other cementitious material, natural stone or an artificial structure.

11. A method for manufacturing a concrete wall panel mounting system for mounting on a wall, the method comprising:

providing a flange configured to be partially embedded within a decorative panel, wherein providing the flange includes providing mounting features for the flange by:

providing a plurality of conical protrusions on the flange protruding from the flange towards the decorative panel, the plurality of protrusions configured to provide an offset from the wall for an additional panel mounted above the decorative panel;

providing a plurality of mounting holes in the flange, each mounting hole proximal to a respective conical protrusion and the flange material about each mounting hole substantially flush with the wall, wherein the flange is configured to rest against the wall when mounted;

providing a plurality of attachment tabs protruding from the flange, the attachment tabs configured to be embedded within a portion of the decorative panel, and wherein the decorative panel is configured to be mounted to the wall using at least some of the plurality of mounting holes.

12. The method of claim 11, wherein providing the flange includes using a metal bending and stamping process.

13. The method of claim 11, wherein providing the flange includes using a metal bending and stamping process on a single piece of metal.

14. The method of claim 11, wherein the decorative panel is configured to be mounted using a fastener configured to pass through each mounting hole of the at least some of the plurality of mounting holes.

15. The method of claim 14, wherein the fastener includes one or more of a screw, a nail, a rivet, a hook, a clip or a tab.

16. The method of claim 11, wherein the plurality of protrusions are configured to provide separation between the panel and the wall to allow for moisture egress or drainage.

17. The method of claim 11, wherein the flange is made from one or more of metal, plastic, or rubber.

18. The system of claim 1, wherein at least one of the plurality of attachment tabs is configured to be attached to an end of the panel.

19. The method of claim 11, wherein the plurality of protrusions are configured to provide more or less relief of a panel mounted the wall.

20. The method of claim 11, wherein the decorative panel includes one or more of a polymer, a plastic, wood, a ceramic, concrete or other cementitious material, natural stone or an artificial structure.

* * * * *